US006161887A

United States Patent [19]

Shiota et al.

[11] Patent Number: 6,161,887

[45] **Date of Patent: *Dec. 19, 2000**

[54] SPREADER FOR MULTISTAGE CONTAINER STACKING

[75] Inventors: Hiroshi Shiota; Masaki Nishioka; Kanji Obata; Ken Murakami, all of Hiroshima, Japan

[73] Assignee: Mitsubishi Heavy Industries, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/026,151

[22] Filed: Feb. 19, 1998

[30] Foreign Application Priority Data

Aug. 26, 1997 [JP] Japan ..... 9-228750

[51] Int. Cl.[7] ..... B66C 1/66

[52] U.S. Cl. ..... 294/81.2; 294/81.41; 294/81.5; 294/907

[58] Field of Search ..... 294/67.1, 68.3, 294/81.1, 81.2, 81.21, 81.41, 81.5, 81.53, 81.54, 907; 212/276, 319, 326, 327; 414/391, 392, 399, 459–461, 607, 608, 626

[56] References Cited

U.S. PATENT DOCUMENTS 4,546,891 10/1985 Lanigen et al. ..... 294/81.21 X
5,354,112 10/1994 Hara et al. ..... 294/81.2 X
5,370,435 12/1994 Monk et al. ..... 294/81.21 X
5,649,636 7/1997 Baumann ..... 294/81.2 X
5,718,550 2/1998 Lanigan et al. ..... 294/81.21 X

FOREIGN PATENT DOCUMENTS 7-323988A 12/1995 Japan .
9-077453A 3/1997 Japan .
9-77453 3/1997 Japan .

*Primary Examiner*—Johnny D. Cherry
*Attorney, Agent, or Firm*—Rothwell, Figg, Ernst & Manbeck, P.C.

[57] ABSTRACT

A spreader for multistage container stacking comprising a flipper beam having a pair of corner flippers upwardly and downwardly movable along the end surface of an end beam of the spreader; a couple of right and left wires paid out from a pair of drums on the end beam, guided vertically downwardly along the opposite ends of the end beam, and tied at the ends thereof to positions straddling the center of gravity of the cross sections of the flipper beam and the corner flipper to support the flipper beam; a flipper lock pin mounting/removing device provided on the vertical side surface of the corner flipper, the flipper lock pin mounting/removing device having a lock pin insertible into and removable from a side surface opening of the spreader or a lower corner fitting of a container; a rotary encoder provided in association with the drums for detecting the amount of upward or downward movement of the flipper beam; and a lower end detecting sensor provided on the flipper beam for detecting the lower end of the container with a layout in which its light is transmitted obliquely in a horizontal plane beside each of the lower corners of the container.

13 Claims, 10 Drawing Sheets

SPREADER FOR MULTISTAGE CONTAINER STACKING

BACKGROUND OF THE INVENTION

This invention relates to a spreader for multistage container stacking.

FIGS. 10 to 12 show the outline of a spreader for multistage container stacking for use in a container yard or the like (Japanese Laid-Open Patent Publication No. 77453/97).

FIG. 10 is a perspective view of the left half of a conventional spreader for multistage container stacking. FIG. 11 is a front view as seen along line XI—XI of FIG. 10. FIG. 12 is a sectional view taken along line XII—XII of FIG. 11. FIG. 13 is a layout drawing of a conventional sensor for detection of a container lower end height.

In FIG. 10, the left half of a spreader 1 is shown as a perspective view, with the obliquely upper left direction representing a direction forward of a crane, the obliquely lower right direction representing a direction rearward of the crane, the obliquely lower left direction representing a direction leftward of the crane, and the obliquely upper right direction representing a direction rightward of the crane.

As illustrated in FIG. 10, the spreader 1 is composed of a spreader body 2 suspended at four points by hoisting ropes 4 paid out from the crane (not shown), and a spreader extensible portion 3 to be symmetrically expanded and contracted in the longitudinal direction by a driving mechanism within the spreader body 2 via a power source and a control cable connected from above the crane.

At the end of each protrusion of the spreader extensible portion 3, an end beam 5 is formed. In each of columns at both ends of the end beam 5, a well known twist lockpin 6 is provided as shown in FIG. 11. The twist lock pins 6 are coupled to or detached from upper corner fittings 50*a* of a container 50 from above to suspend or release the container 50.

From the end beam 5, as will be described later on, a flipper beam 7 is suspended by wires 14. To both ends of the flipper beam 7, a pair of symmetrical corner flippers 8 are integrally fixed. On the vertical side surface part of the corner flipper 8, a flipper lock pin mounting/removing device 9 is provided.

At the middle of the upper surface of the end beam 5, a pair of drums 10 are disposed adjacent and parallel to each other. Synchronous gears 11 are attached to the drums 10 for engaging each other. To one of the drums 10, a driving motor 12 is connected.

On each of support bases 15 of the columns at the opposite ends of the end beam 5, a pair of guide sheaves 13 are provided.

The pair of drums 10 are wound with the end parts of the pair of wires 14. These wires 14 are passed over the respective guide sheaves 13 at the opposite ends of the end beam 5, and guided downward. The other end part of the wire 14 is tied to two locations straddling the center of gravity of the cross sections of the flipper beam 7 and the corner flipper 8 to support the flipper beam 7.

The side surfaces of the columns at the opposite ends of the end beam 5 are each provided with a couple of upper and lower binding openings 5*a*, 5*b* which bind to the flipper lock pin mounting/removing device 9.

The upper opening 5*a* is a flipper pin binding portion foruse in retracting the flipper 8, while the lower opening 5*b* is a flipper pin binding portion used when the flipper 8 is at a predetermined corner guide position.

Between the side part of the end beam 5 and the side part of the flipper beam 7, a extensible rod type swing suppressor 17 is connected as shown in FIG. 11.

The swing suppressor 17 is composed of a short cylindrical guide 18 supported on an inward part of a low-level mounting base 15*a* at each of the opposite ends of the end beam 5 by a horizontal shaft 18*a* so as to be tiltable in the direction of the spreader length; a second cylindrical guide 19 supported in the cylindrical guide 18 by a stop flange 19*a* at the upper end so as to be slidable within the cylindrical guide 18; an extensible rod 20 supported in the second cylindrical guide 19 by a stop flange 20*a* at the upper end so as to be slidable within the second cylindrical guide 19; and a swing adjusting cylinder 21 provided on the mounting base 15*a* so as to be tiltable and having a driving end thereof connected to an upper part of the cylindrical guide 18 so as to be tiltable.

The extensible rod 20, in an expansible and contractible condition, has an eye plate 20*b*, which is provided at the lower end thereof, connected via a shaft 20*c* to a bracket 8*b* overhanging from the corner flipper 8.

Thus, when the cylinder 21 is contractedly driven, the cylindrical guide 18 is turned counterclockwise in FIG. 11. The pair of corner flippers 8 are pressed against the end surface of the container via the second cylindrical guide 19 and the extensible rod 20. At this time, the center of the flipper lock pin mounting/removing device 9 just lies on the vertical center line of the side surface openings of the corner fittings 50*a*, 50*b* of the container 50.

Upon the expanding driving of the cylinder 21, the cylindrical guide 18 is turned clockwise in FIG. 11. Thus, the corner flippers 8 are separated from the end surface of the container 50 by a certain distance, and can be hoisted or lowered.

Directly below the flipper lock pin mounting/removing devices 9, photoelectric switches 52 for detecting the lower end of the container are provided in the pair of corner flippers 8 in a direction in which they are opposed to each other, as shown in FIG. 12.

That is, the photoelectric switch 52 is provided downwardly apart from the center of the flipper lock pin mounting/removing device 9 by a distance ($L_1$+$L_2$) which is the sum of the altitudinal distance $L_1$ from the lower end of the container 50 to the center of the opening of the lower corner fitting 50*b*, and the lowering distance $L_2$ from the position of actuation of the photoelectric switch 52 (the lower end of the container) to the position at which the flipper beam 7 stops descending. On the actuation of the photoelectric switch 52, the center of the flipper lock pin mounting/removing device 9 stops at the height of the center of the opening of the lower corner fitting 50*b*.

In FIG. 12, the numeral 9*a* denotes a lock pin to be inserted or removed by the flipper lock pin mounting/removing device 9, and the numeral 8*a* denotes the taper guide surface of the corner flipper 8.

A hydraulic hose and an electric cable (not shown) which are connected from the top of the spreader to the top of the flipper beam 7 are held by an automatically wound reel or the like situated on the spreader. In accordance with the descent of the flipper beam 7, the hydraulic hose and the electric cable are pulled out of the automatically wound reel. As the flipper beam 7 ascends, the hydraulic hose and the electric cable are taken up by the automatically wound reel.

Handling work for the container 50 by the above-described spreader 1 is performed in the following manner:

First, the wires 14 are unwound by the drums 10, and the lock pin 9*a* is removed and mounted by the flipper lock pin mounting/removing device 9 to move the corner flipper 8 from the position of the upper opening 5*a* to the position of the lower opening 5*b* of the spreader 1 and lower the flipper beam 7 onto the container 50 to be hoisted.

Guide by the taper surface 8*a* of each corner flipper 8 causes the spreader 1 to fit on and land on the container 50. Then, the twist lock pin 6 is fitted into the upper surface hole of the container upper corner fitting 50*a* to lift the spreader 1 and carry it horizontally.

Then, the carried container 50 is to be stacked on another container in the yard. For this purpose, the flipper lock pin 9*a* is detached from the lower opening 5*b* of the spreader 1 during the horizontal carriage. Also, the drums 10 are driven to lower the flipper beam 7, and the flipper pin 9*a* is inserted into and joined to the side surface opening of the lower corner fitting 50*b* of the container 50. In this condition, the container 50 is lowered onto another container in the yard.

The carried container 50 is guided by the corner flipper 8 mounted on the lower corner fitting 50*b*, whereby it is fitted on and landed on another container.

Then, the flipper lock pin 9*a* is detached from the container lower corner fitting 50*b*, and the drums 10 are driven to lift the flipper beam 7. The flipper lock pin 9*a* is inserted into and joined to the lower opening 5*b* of the spreader 1, and the twist lock pin 6 is released from the carried container 50. Only the spreader 1 is lifted, and moved to the position of the next container 50 to be carried. In this manner, carriage of the container is repeated.

The above-mentioned conventional spreader 1 poses the following problems:

On the bottom surface of the container 50 that often contacts the floor during distribution of the container 50, corrugated board pieces or thin plate pieces may engage into the gap between the frame and the bottom plate, or paper or vinyl pieces may stick to the flat part of the bottom frame via an adherent material or the like.

This foreign matter on the bottom surface of the container 50 poses difficulty in doing the aforementioned work for shifting the flipper beam 7 to the position of the lower corner fitting 50*b* of the container 50.

Assume, for example, that the photoelectric switch 52 of the spreader 1 for detecting the lower end of the container is a transmission type one comprising a light projector 52*a* and a light receiver 52*b*, as shown in FIG. 13(*a*). The flipper beam 7 descends along the container 50, and goes beyond the lower end of the container 50. If foreign matter 53 adheres to the frame lower surface of the container 50, the foreign matter 53 blocks the light path of the photoelectric switch 52, making the photoelectric switch 52 fail to function. At a position past the foreign matter 53, the photoelectric switch 52 acts with delay. This delay in the actuation of the photoelectric switch 52 is caused even by a tiny foreign matter 53.

Thus, during a handling operation for the container 50, the corner flipper 8 may not be aligned with and fixed to the container lower corner fitting 50*b*. This may require that the handling work be interrupted, and inspection and correction of abnormalities be performed.

Even when the photoelectric switch 52 detects the lower end of the container at the normal position, a change cannot be avoided in the distance $L_2$ traveled until the stoppage of the descent of the flipper beam 7. This makes it difficult to align the flipper lock pin 9*a* with the center of the side surface opening of the container lower corner fitting 50*b*.

When a single reflection type light projector/receiver 52*c* is used as the photoelectric switch 52 as in FIG. 13(*b*), the irregular reflection of light due to the irregularities of the container wall surface makes the precise operation of the photoelectric switch 52*c* difficult. Foreign matter 53 adhering to the lower surface of the container also precludes the operation of the photoelectric switch 52*c*.

Furthermore, the hydraulic hose and the electric cable connected from the spreader 1 to the flipper beam 7 wear owing to repeated unwinding and winding. When they are rubbed against the end surface of the container during the upward or downward movement of the flipper beam 7, they may be damaged.

SUMMARY OF THE INVENTION

The present invention has been accomplished in the light of the above-described problems with earlier technologies. Its object is to perform the accurate detection of the lower end of the container by the photoelectric switch, enable easy and accurate control for aligning the corner flipper with the container lower corner fitting in the height direction, and prevent damage to the hydraulic hose-electric cable connection line between the spreader and the flipper beam.

A first aspect of the invention for attaining the above object is a spreader for multistage container stacking, which comprises a flipper beam having a pair of corner flippers upwardly and downwardly movable along the end surface of an end beam of the spreader; a couple of right and left wires paid out from a pair of drums on the end beam, guided vertically downwardly along the opposite ends of the end beam, and tied at the ends thereof to positions straddling the center of gravity of the cross sections of the flipper beam and the corner flipper to support the flipper beam; a flipper lock pin mounting/removing device provided on the vertical side surface of the corner flipper, the flipper lock pin mounting/removing device having a lock pin insertable into and removable from a side surface opening of the spreader or a lower corner fitting of a container; a rotary encoder provided in association with the drums for detecting the amount of upward or downward movement of the flipper beam; and a lower end detecting sensor provided on the flipper beam for detecting the lower end of the container with a layout in which its light is transmitted obliquely in a horizontal plane beside each of the lower corners of the container.

A second aspect of the invention for attaining the above object is the spreader for multistage container stacking according to the first aspect in which a link arm is coupled to shafts between the end beam and the flipper beam so as to be foldable along the end surface of the end beam, and a hydraulic hose and an electric cable are held on the link arm for connection between the end beam and the flipper beam.

A third aspect of the invention for attaining the above object is the spreader for multistage container stacking according to the first or second aspect, further including a control unit which downwardly moves the flipper beam while detecting the amount of downward movement of the flipper beamby the rotary encoder; detects the height of the lower end of the container by the lower end detecting sensor to stop the descent of the flipper beam; and lifts the flipper beam at a creep speed in accordance with a correction amount calculated, thereby to register the lock pin with the central position of the side surface opening of the container lower corner fitting in the height direction.

A fourth aspect of the invention for attaining the above object is the spreader for multistage container stacking according to the first or second aspect, further including a control unit which downwardly moves the flipper beam while detecting and monitoring the amount of movement of the flipper beam by the rotary encoder; detects the height of the lower end of the container by the lower end detecting sensor to stop the descent of the flipper beam, and starts the creep-speed ascent of the flipper beam; and stops the creep-speed ascent of the flipper beam in response to a signal produced when the lower end detecting sensor detects the height of the lower end of the container, thereby registering the lock pin with the central position of the side surface opening of the container lower corner fitting in the height direction.

A fifth aspect of the invention for attaining the above object is the spreader for multistage container stacking according to the third or fourth aspect, in which the height of the container to be hoisted by the spreader can be detected individually based on the detection by the rotary encoder of an ascending or descending distance during the upward or downward movement of the flipper beam, and the detection of the lower end of the container by the lower end detecting sensor.

DETAILED DESCRIPTION OF THE PREFERRED EMBODIMENTS

The present invention will now be described in detail with reference to its embodiments shown in the accompanying drawings.

Figure 1:
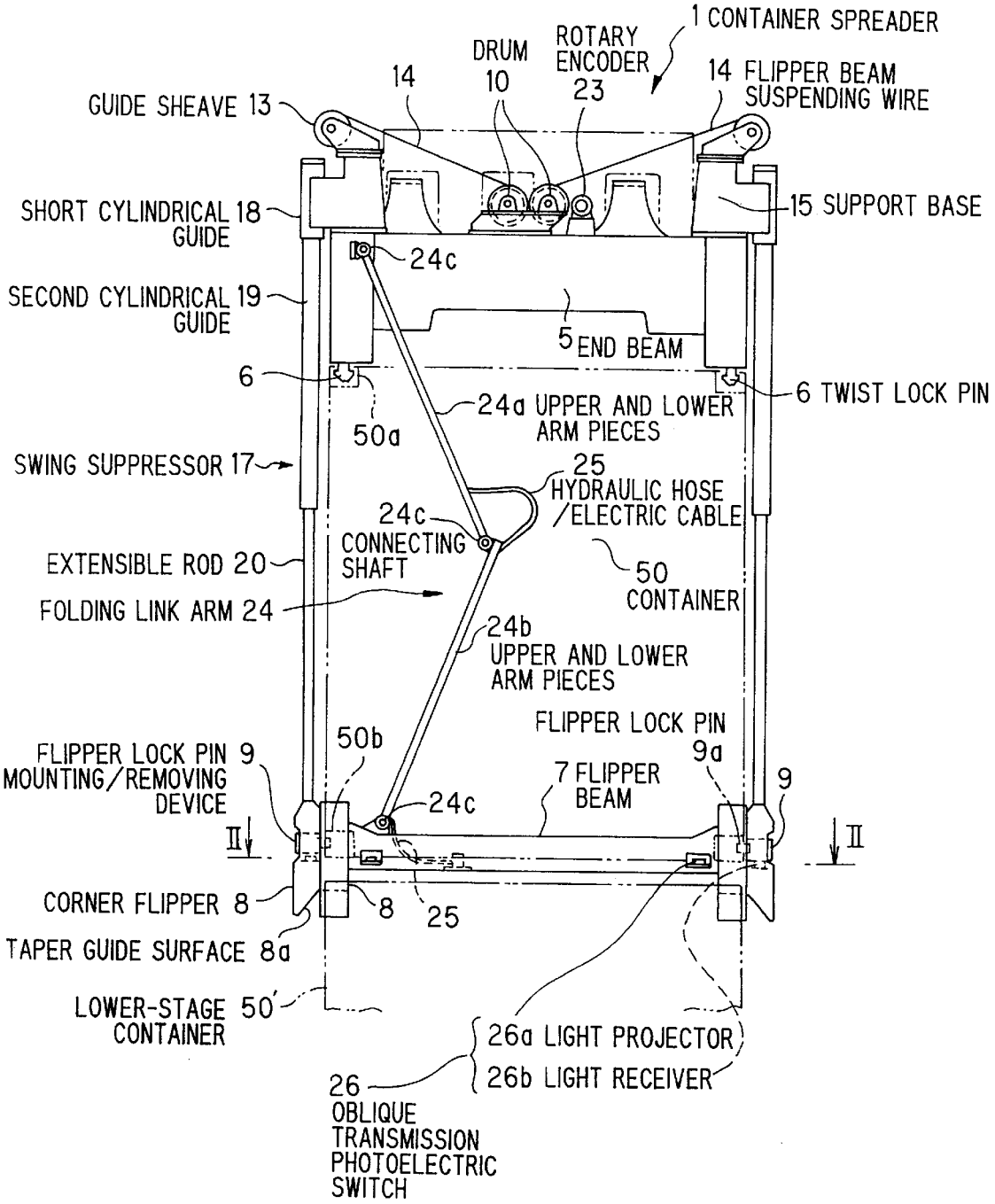
FIG. 1 is a side view of a spreader for multistage container stacking concerned with an embodiment of the present invention.
Figure 2:
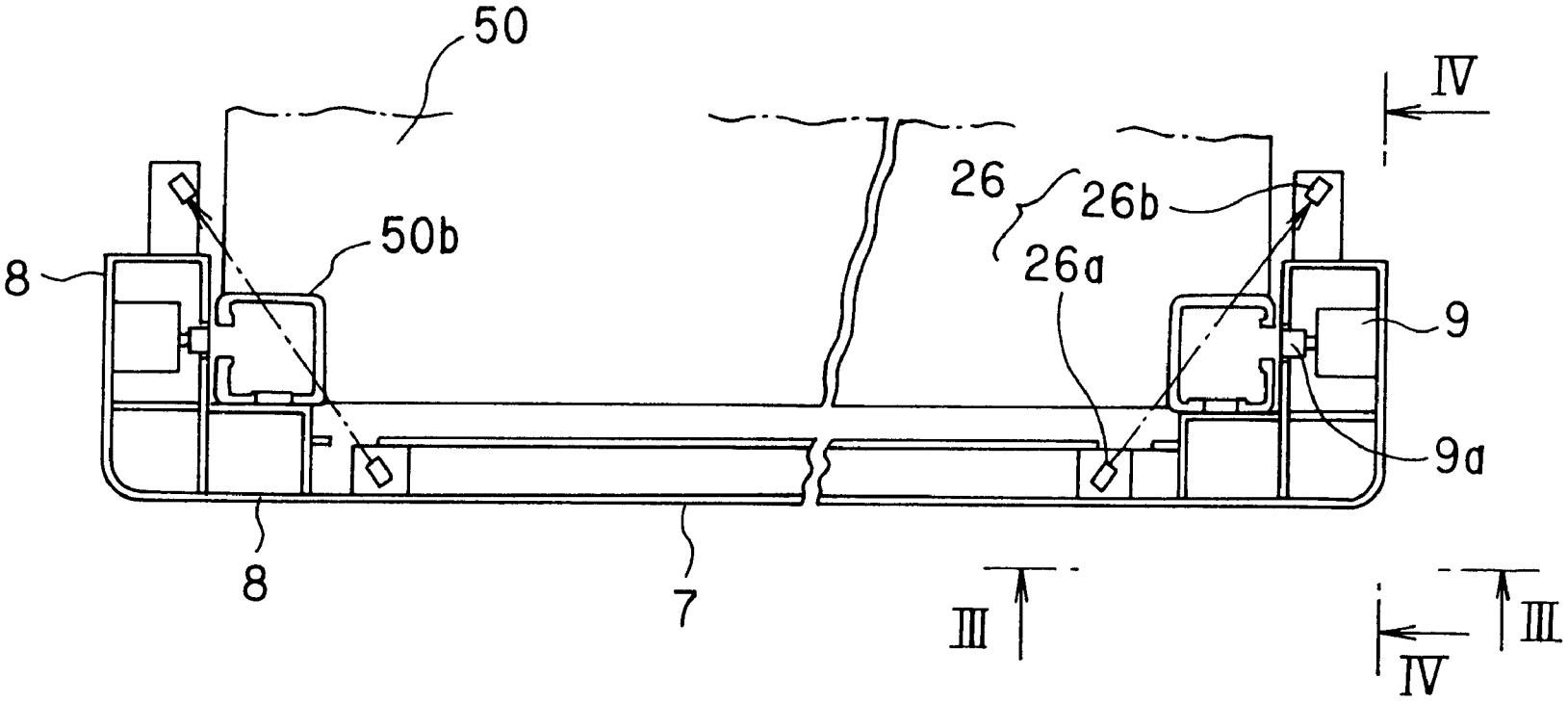
FIG. 2 is a horizontal sectional view taken along line II—II of FIG. 1.
Figure 3:
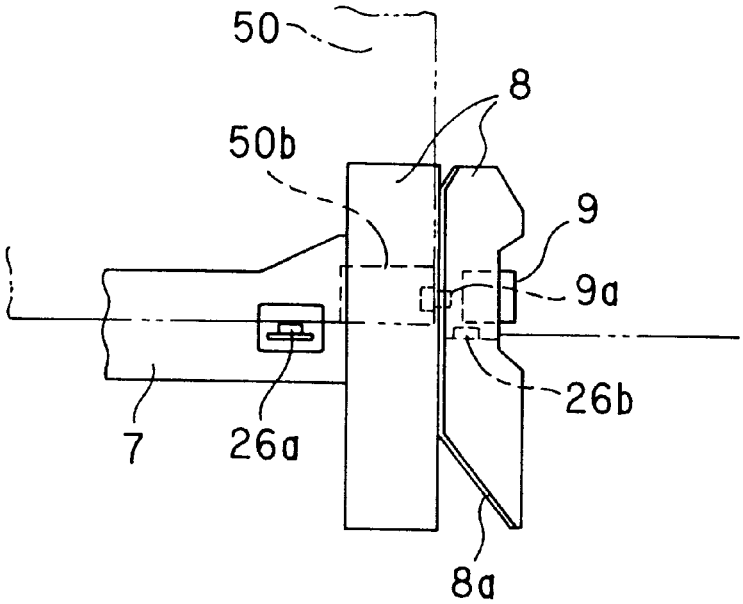
FIG. 3 is a side view as seen along line III—III of FIG. 2.
Figure 4:
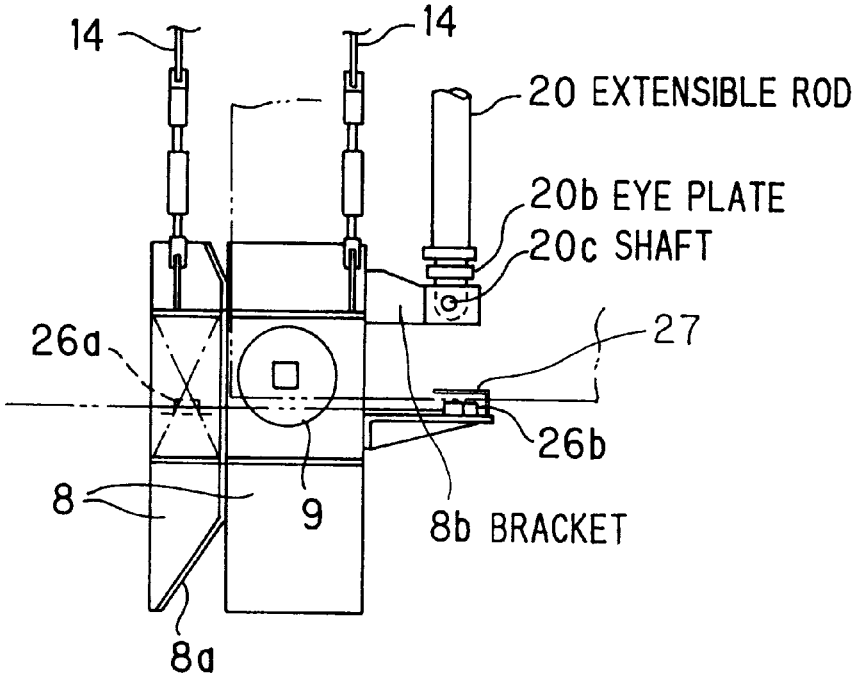
FIG. 4 is a front view as seen along line IV—IV of FIG. 2.
Figure 5:
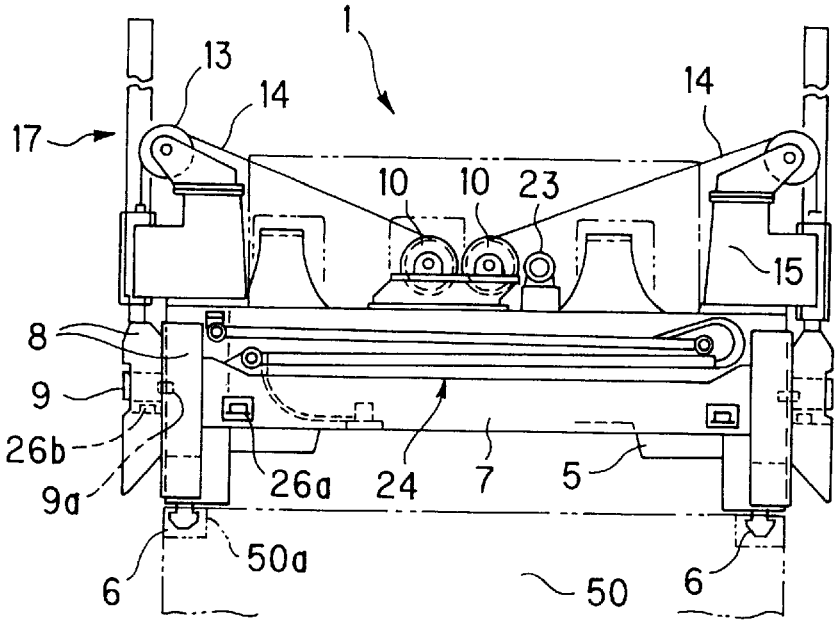
FIG. 5 is a side view of the container spreader at rest.
Figure 6:
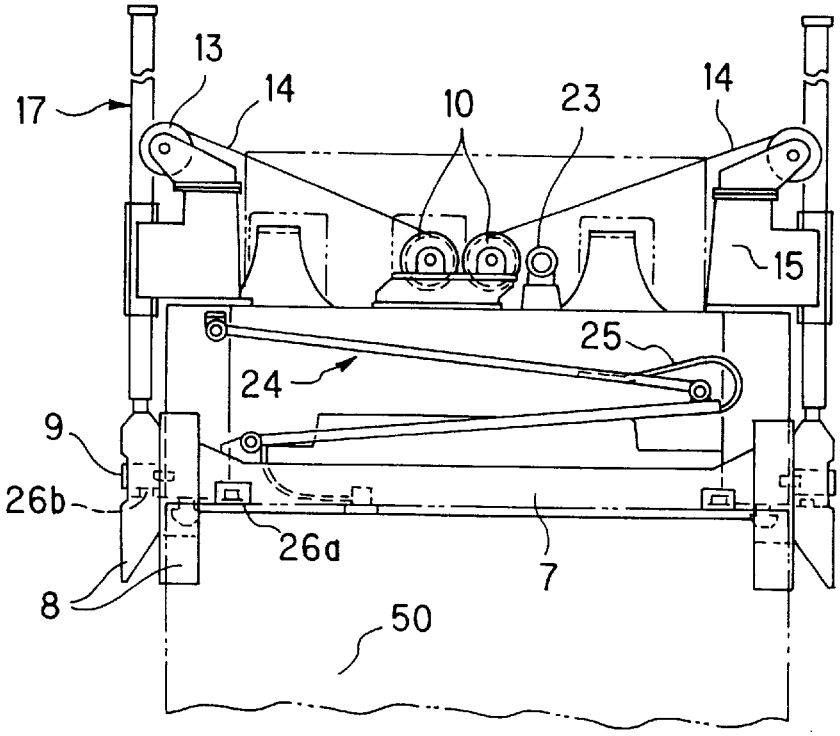
FIG. 6 is a side view of the spreader when hoisting a container.

A spreader for multistage container stacking concerned with an embodiment of the present invention is shown in FIGS. 1 to 6. FIG. 1 is a side view of the container spreader concerned with this embodiment. FIG. 2 is a horizontal sectional view taken along line II—II of FIG. 1. FIG. 3 is a side view as seen along line III—III of FIG. 2. FIG. 4 is a front view as seen along line IV—IV of FIG. 2. FIG. 5 is a side view of the container spreader at rest. FIG. 6 is a side view of the spreader when hoisting a container.

This embodiment is based on the aforementioned conventional container spreader. The same parts as in the earlier technologies are assigned the same numerals or symbols, and overlapping explanations are omitted.

FIG. 1 shows the state of a corner flipper 8 being set at a height at which it is used as a guide for a lower-stage container 50'.

As shown in FIG. 1, a rotary encoder 23 linked to drums 10 is provided on an end beam 5.

The rotary encoder 23 is used to detect the number of revolutions of the drums 10, and detect the length of wires 14 paid out of the drums 10 on the basis of the detected number of revolutions of the drums 10.

Between the front side of the end surface of the end beam 5 and the front side of the flipper beam 7, a folding link arm 24 is connected.

The folding link arm 24 is constructed by turnably connecting an upper arm piece 24*a* and a lower arm piece 24*b* together by a shaft 24*c*, and connecting the other end of the upper arm piece 24*a* and the other end of the lower arm piece 24*b* to the end beam 5 side and the flipper beam 7 side, respectively, by the shafts 24*c* so as to be turnable along the end surface of the end beam 5.

On the arm pieces 24*a*, 24*b* of the folding link arm 24, a hydraulic hose and an electric cable (collectively designated as 25) for driving are supported and led from the spreader 1 side to the flipper beam 7.

The wiring for the hydraulic hose/electric cable 25 on the spreader 1 and the flipper beam 7 is omitted in the drawing.

The flipper beam 7 and corner flippers 8 are provided with two sets of photoelectric switches 26 so that light is transmitted obliquely in a horizontal plane at the four corners of a container 50 as shown in FIGS. 2 to 4.

Each photoelectric switch 26 comprises a light projector 26*a* and a light receiver 26*b*. The light projector 26*a* and light receiver 26*b* are attached, opposite each other in a light-transmissible manner, at a slightly lower level than a flipper lock pin mounting/removing device 9, with one of them being supported in the flipper beam 7 and the other being supported on the outer surface in the container length direction of the corner flipper 8 opposed to the side surface of the container.

The light projector 26*a* or light receiver 26*b* provided on the outer surface of the corner flipper 8 is provided with a waterproof cover 27 as shown in FIG. 4.

Figure 7:
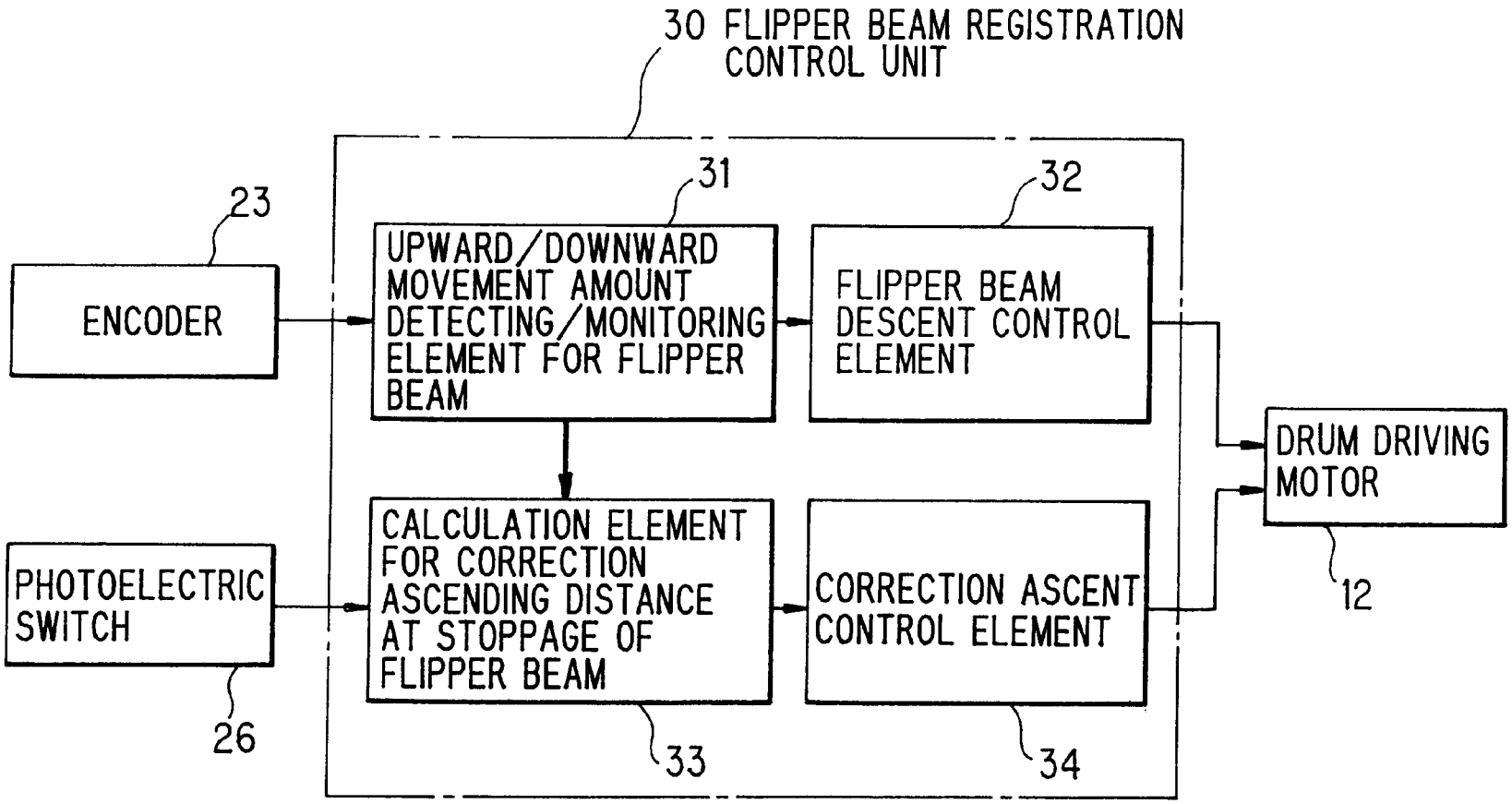
FIG. 7 is a block diagram of a structural example of a registration control unit for a flipper beam.

As illustrated in FIG. 7, an upper/lower position registration control unit 30 for the flipper beam 7 is provided in the instant embodiment.

The registration control unit 30 is composed of an upward/downward movement amount detecting/monitoring element 31, a descent control element 32, a correction distance calculation element 33, and a correction ascent control element 34.

The upward/downward movement amount detecting/monitoring element 31 finds the upward/downward movement amount of the flipper beam 7 based on a signal received from the rotary encoder 23 to monitor its descent.

The descent control element 32 controls the unwinding of the drums 10 via a drum driving motor 12 so that the flipper beam 7 descends at a relatively high speed.

The correction distance calculation element 33 obtains a correction distance over which the flipper beam 7 should ascend after stopping descent, on the basis of signals from the photoelectric switch 26 and the upward/downward movement amount detecting/monitoring element 31.

The correction ascent control element 34 controls the hoisting by the drums 10 via the drum driving motor 12 so that the flipper beam 7 ascends at a creep speed after its descent stops.

The registration control element 30, as an example, controls the descent of the flipper beam 7 at a moving speed of about 500 mm/sec and its correction ascent at a moving speed of about 50 mm/sec.

Figure 10:
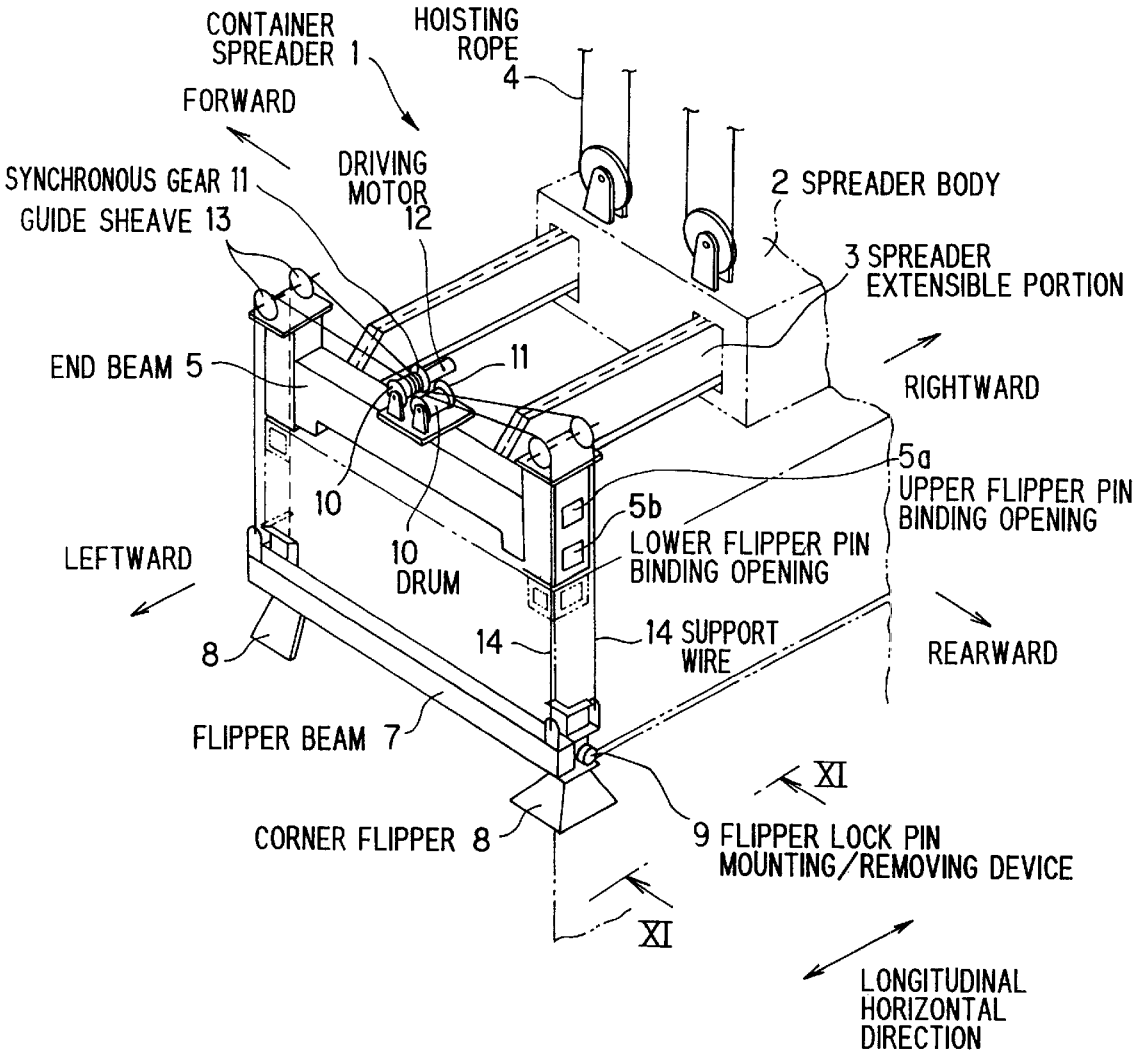
FIG. 10 PRIOR ART
FIG. 10 is a perspective view of the left half of a conventional spreader for multistage container stacking.
Figure 11:
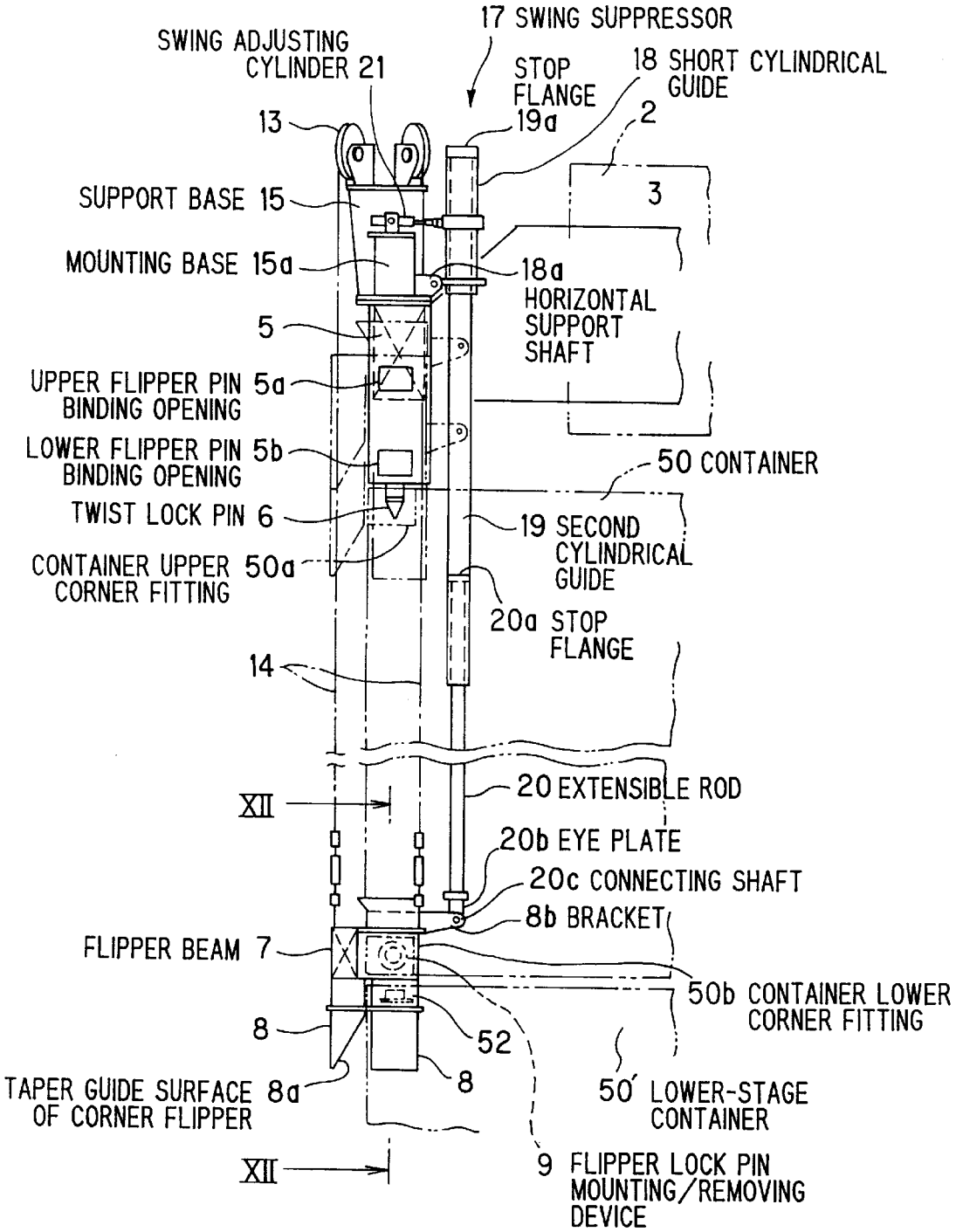
FIG. 11 PRIOR ART
FIG. 11 is a front view as seen along line XI—XI of FIG. 10.
Figure 12:
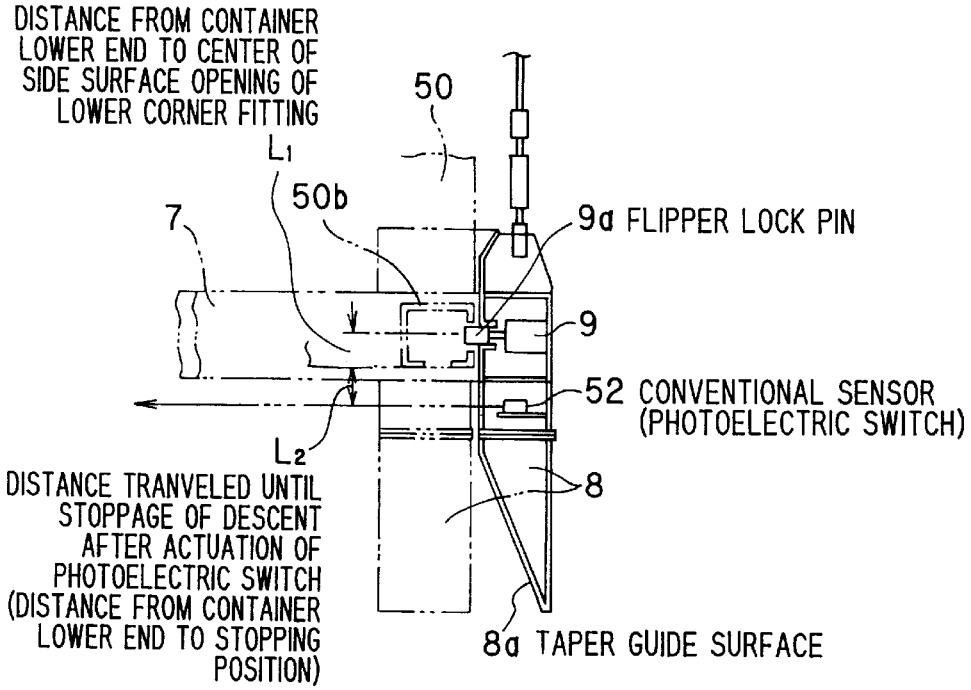
FIG. 12 PRIOR ART
FIG. 12 is a sectional view taken along line XII—XII of FIG. 11.
Figure 13:
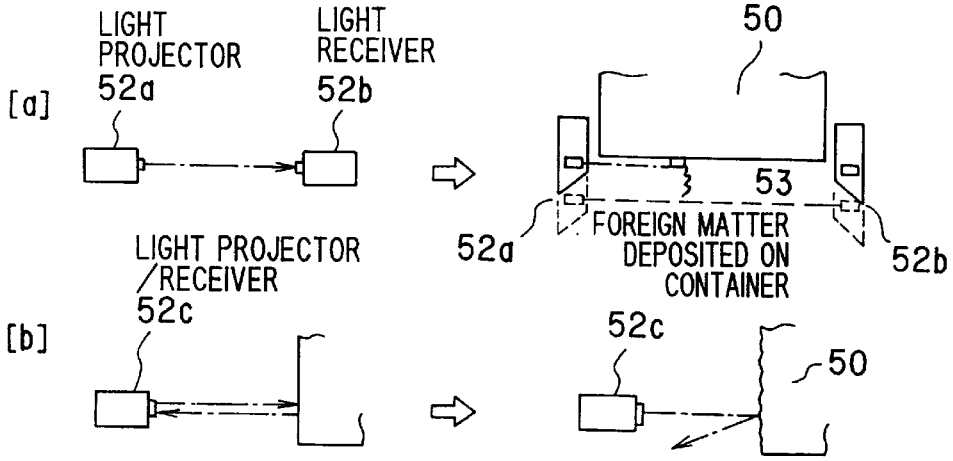
FIG. 13 PRIOR ART
FIG. 13 is a layout drawing of a conventional sensor for detecting the lower end height of a container.

The other parts of the spreader 1 may be of the same structure as in the conventional spreader illustrated in FIGS. 10 to 12.

Figure 8:
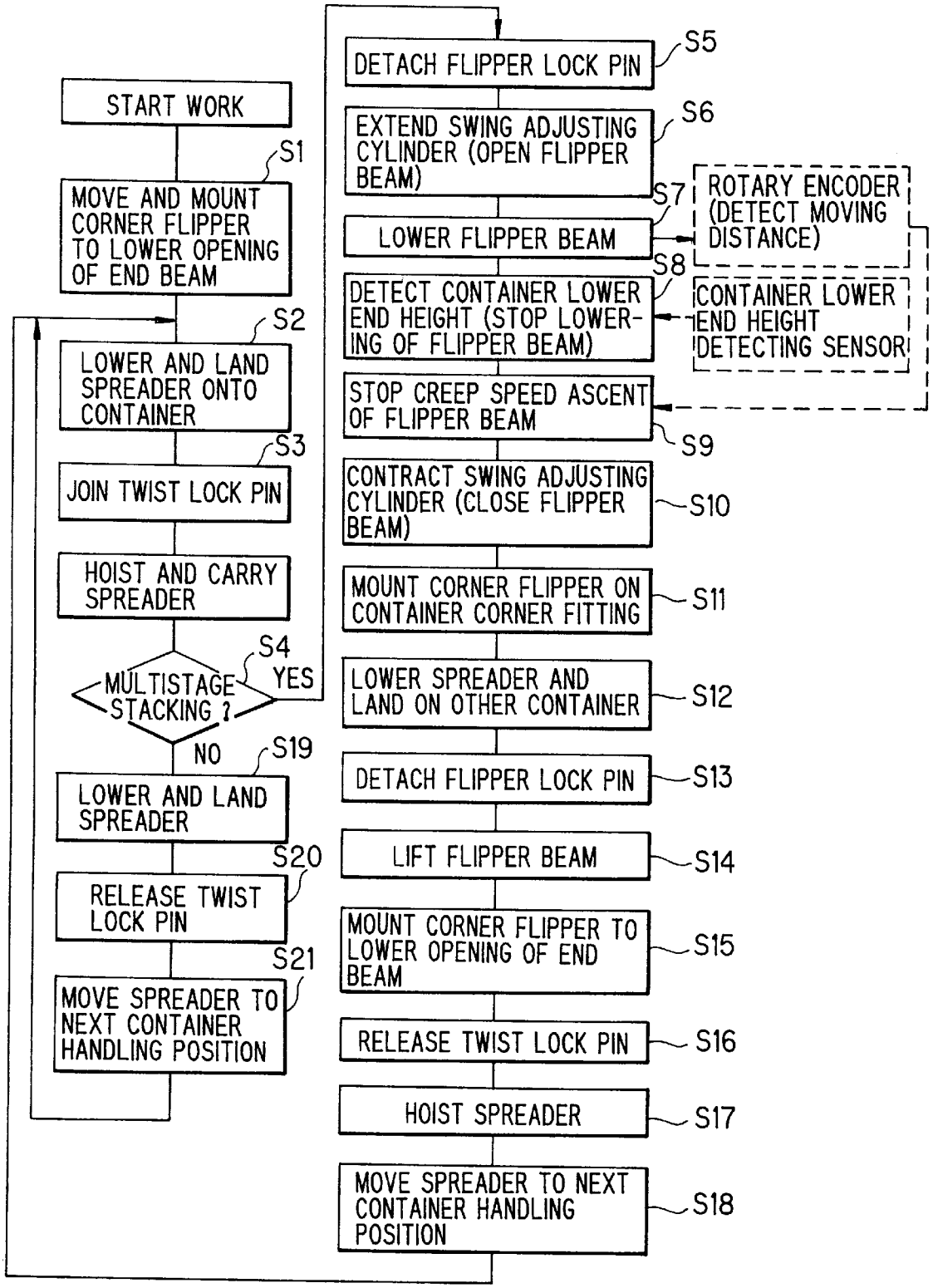
FIG. 8 is a flow chart for the outline of container handling work by the spreader.

The spreader for multistage container stacking of the instant embodiment having the foregoing constitution does container handling work in the following manner in accordance with the flow chart given as FIG. 8:

To start handling work for a container, corner flippers 8 are retracted at a retraction height as shown in FIG. 5. In this state, a flipper lock pin 9*a* is detached from an upper opening 5*a* of an end beam 5. The drums 10 are driven for unwinding, and the flipper lock pin 9*a* of the corner flipper 8 is coupled to a lower opening 5*b* of the end beam 5 to set the corner flipper 8 at an ordinary height for use as shown in FIG. 6 (Step S1).

Then, the spreader 1 in the state shown in FIG. 6 is moved downwardly above the container 50 to be hoisted, and fitted and landed on the container 50 by the guide of the corner flipper 8 (Step S2).

Subsequently, a twist lock pin 6 is joined to an upper surface hole of an upper corner fitting 50*a* of the container 50, where after the spreader 1 is hoisted and carried (Step S3).

If the container 50 carried is subjected to multistage stacking on other container 50' (Step S4), the flipper lock pin 9*a* is removed from the lower opening 5*b* of the spreader 1 (Step S5) during carriage of the container 50. Also, a swing adjusting cylinder 21 is driven for expansion, thereby swinging the flipper beam 7 so as to become apart slightly from the container end (Step S6). The flipper beam 7 is lowered at an unwinding speed of about 500 mm/sec (Step S7).

Lowering by this method prevents the descent of the flipper beam 7 from being impeded, for example, by foreign matter adhering to the end surface of the container 50.

Then, a photoelectric switch 26 housed in the descending flipper beam 7 acts at a position beyond the lower end of the container 50, whereupon the descent of the flipper beam 7 is automatically stopped (Step S8).

At this time, the photoelectric switch 26 detects its passage beside the lower end of the container 50 because of light transmitted horizontally in the oblique direction below the lower corner fitting 50*b* of the container 50.

The lower surface portion of the lower corner fitting 50*b*, the position of detection by the photoelectric switch 26, is the site where load is transmitted. Thus, foreign matter 53 deposits there less frequently, and it suffices for the single photoelectric switch 26 on one side to detect the lower end of the container 50 at the normal position and become active. Hence, the delay in the actuation of the photoelectric switch 26 due to deposition of foreign matter 53 markedly decreases, and the efficiency of container handling operation increases.

At the position where the descent of the flipper beam 7 automatically stops, moreover, the upward/downward movement amount detecting/monitoring element 31 of the registration control unit 30 shown in FIG. 7 calculates the moving distance. Based on this moving distance, the altitudinal size of the container 50 supported by the spreader 1 is automatically determined, and stored in the computer.

Simultaneously, the correction ascending distance calculation element 33 calculates a correction distance in the upward direction from the stopping position. The correction ascent control element 34 upwardly moves the flipper beam 7 at an ascending speed of about 50 mm/sec (Step S9). Also, the driving of the swing adjusting cylinder 21 for contraction returns the flipper beam 7 to a position at which the flipper beam 7 contacts the end surface of the container 50 (Step S10). As a result, the flipper lock pin 9*a* is registered with the center of the side surface opening of the lower corner fitting 50*b* of the container 50.

At this time, the correction distance is determined as the distance $L_2$ from the lower end of the container 50 to the position at which the descent of the flipper beam 7 actually stops. This distance $L_2$ is obtained as the difference between the moving distance and the height of the container 50 that has been determined by the upward/downward movement amount detecting/monitoring element 31.

That is, if the distance $L_2$ traveled until the descent of the flipper beam 7 actually stops changes, this change is calculated as the correction distance. Based on this distance $L_2$, creep-speed correction ascent is performed.

With this correction ascent control, the actual moving distance of the flipper beam 7 detected by the upward/downward movement amount detecting/monitoring element 31 can be fed back for control.

Thus, the accuracy of registration in the height direction between the flipper lock pin 9*a* on the flipper beam 7 and the center of the side surface opening of the container lower corner fitting 50*b* is marvelously increased, and the effect of smoothing automatic registration is obtained.

The above-described registration by the registration control unit 30 may be performed by a method which monitors the moving state by the upward/downward movement amount detecting/monitoring element 31 and the correction ascending distance calculation element 33, lowers the flipper beam 7 at a high speed of about 500 mm/sec by the descent control element 32, stops the lowering of the flipper beam 7 based on a container lower end detection signal from the photoelectric switch 26, starts the ascent of the flipper beam 7 at a creep speed of about 50 mm/sec by the correction ascent control element 34, and stops the ascent of the flipper beam 7 based on an OFF signal issued when the photoelectric switches 26 on both sides of the flipper beam 7 detect the container lower end. This method also permits the exact registration of the flipper lock pin 9*a* with the center of the side surface opening of the lower corner fitting 50*b* of the container 50 in the height direction.

When registration is completed, the flipper lock pin 9*a* is coupled to the container lower corner fitting 50*b* (Step S11). The spreader 1 is lowered above other container 50' for stacking, to land the container by the guide of the corner flipper 8 (Step S12).

Then, the flipper lock pin 9*a* is detached from the container lower corner fitting 50*b* (Step S13), raised to the height of the lower opening 5*b* of the spreader 1 (Step S14), and inserted into the lower opening 5*b* for coupling (Step S15). The twist lock pin 6 is released from the container upper corner fitting 50*a* (Step S16), and only the spreader 1 is hoisted (Step S17) for movement to the next position of container handling. Then, a similar container handling task can be repeated (Step S18).

If multistage stacking is not performed (Step S4), the flipper beam 7 can be left to remain in the state illustrated in FIG. 6. With this state maintained, the task of hoisting and carrying the container 50 and lowering it onto the ground or the chassis of a trailer or the like can be repeated (Steps S19 to S21).

During the hoisting/lowering and detachment/reattachment of the flipper beam 7 accompanying the handling of a container for multistage stacking, the hydraulic hose-electric cable combination 25 is fixedly supported on the arm pieces 24*a*, 24*b* of the folding link arm 24 and held there in a folded manner. Thus, the wear of the hydraulic hose-electric cable combination 25 due to unwinding or winding, and its damage associated with rubs against the container end surface are prevented reliably.

Figure 9:
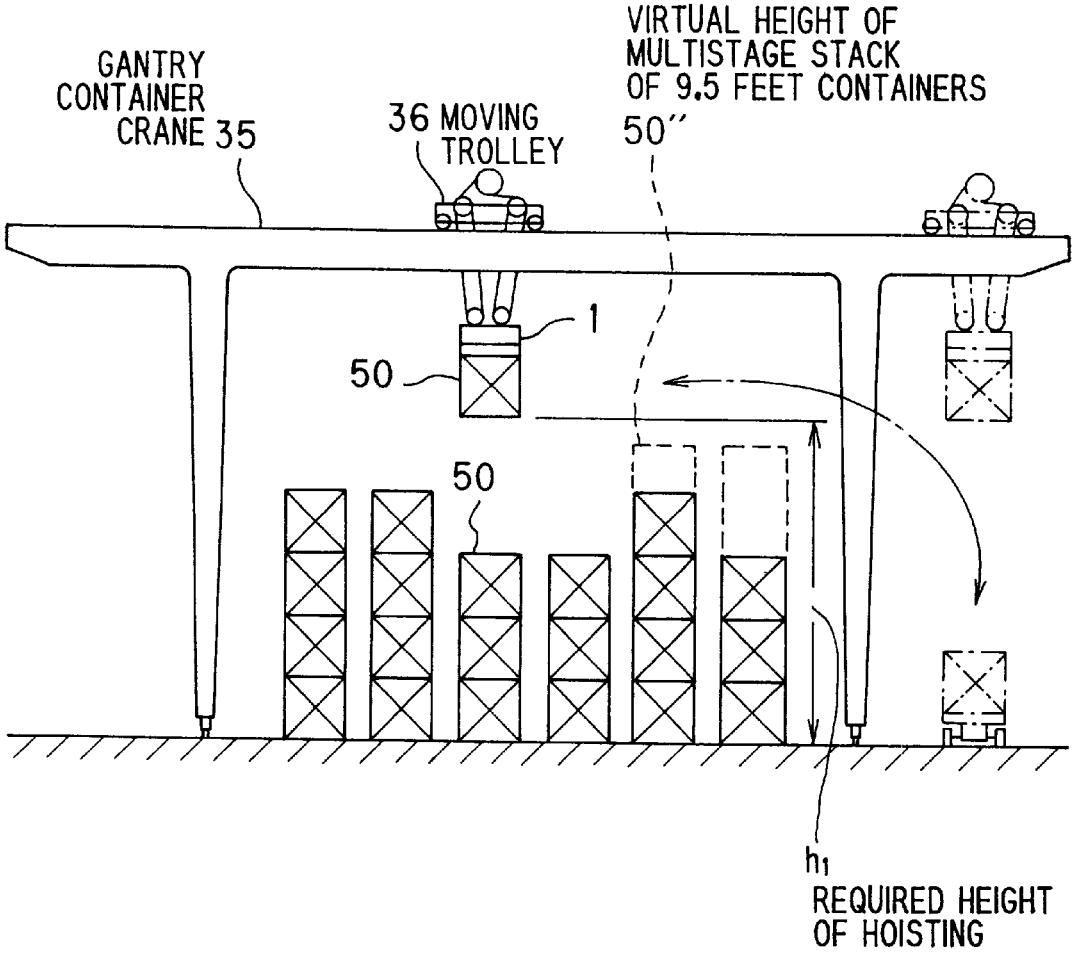
FIG. 9 is a front view of a container handling state of a crane using a spreader for multistage container stacking concerned with another embodiment of the present invention.

FIG. 9 shows a spreader for multistage container stacking concerned with another embodiment of the present invention.

In this embodiment, a container spreader 1 of the aforementioned constitution is applied onto a moving trolley 36 for a gantry crane 35 straddling stacked containers stored in a stacked container storage yard.

Containers 50 are constant in width (8 feet) but different in length and height.

The height of the container in general use is, say, 8 feet, 8.5 feet, 9 feet or 9.5 feet.

In the storage of containers in the container yard, information on the height dimension of containers by address and stack stage has not been correctly managed. Thus, stacking work for containers 50 by a container crane in the yard has been performed on the assumption that the maximum number of stages of containers 50 of the maximum height dimension 9.5 feet have been stacked, as indicated by a dashed line 50" in FIG. 9. On this assumption, the required height $h_1$ for container hoisting during horizontal carriage of the container by a spreader 1 has been kept to carry out stacking or withdrawal of the containers.

If a row of stacked containers 50 having a small height dimension is included, therefore, container handling may have to be repeated with the carried container detouring to an excess altitude.

According to the container spreader 1 of the instant embodiment, whenever the container 50 to be stacked is hoisted, the flipper beam 7 is lowered to the container lower end detection height, whereby the individual container height can be detected. This information on the container height can be recorded into the computer for management of the container yard.

In handling a container which is not to be stacked, it suffices to carry out the procedure of vertically reciprocating the flipper beam 7 to a height, at which the photoelectric switch 26 acts, during carriage of the container. This makes it possible to detect the individual container height and record this information on the container height into the computer for management.

Hence, each time container handling is performed, information on the total height of the maximum number of stages stacked in the entire width direction of the storage site, as well as information on the individual container height, by storage address in the yard can be retrieved from the managing computer, and supplied to the container crane 35.

In stacking a fresh stage of containers or withdrawing containers in the container yard, therefore, the spreader 1 is moved at a reasonable height of container hoisting for each container handling work. This work is performed based on information on the total height of the maximum number of stages stacked in the entire width direction of the storage site, the information retrieved from the managing computer. This gives the effect that highly efficient container handling can be done in minimum carriage cycle time.

As described concretely above based on the embodiments, the spreader for multistage container stacking related to the first aspect of the invention comprises a flipper beam having a pair of corner flippers upwardly and downwardly movable along the end surface of an end beam of the spreader; a couple of right and left wires paid out from a pair of drums on the end beam, guided vertically downwardly along the opposite ends of the end beam, and tied at the ends thereof to positions straddling the center of gravity of the cross sections of the flipper beam and the corner flipper to support the flipper beam; a flipper lock pin mounting/removing device provided on the vertical side surface of the corner flipper, the flipper lock pin mounting/removing device having a lock pin insertible into and removable from a side surface opening of the spreader or a lower corner fitting of a container; a rotary encoder provided in association with the drums for detecting the amount of upward or downward movement of the flipper beam; and a lower end detecting sensor provided on the flipper beam for detecting the lower end of the container with a layout in which its light is transmitted obliquely in a horizontal plane beside each of the lower corners of the container. Thus, the descent position of the lower corner fitting to which foreign matter may minimally adhere can be detected reliably with the lower end detecting sensor. Also, the precision of registration between the flipper lock pin on the flipper beam and the center of the side surface opening of the container lower corner fitting in the direction of height can be marvelously increased. This gives the effect of smoothing automatic registration.

The spreader for multistage container stacking related to the second aspect of the invention is the spreader for multistage container stacking according to the first aspect in which a foldable link arm is coupled to shafts between the end beam and the flipper beam so as to be foldable along the end surface of the end beam, and a hydraulic hose and an electric cable are held on the link arm for connection between the end beam and the flipper beam. Thus, during the hoisting/lowering and detachment/reattachment of the flipper beam, the hydraulic hose and the electric cable are held on the link arm in a folded manner. This gives the effect of preventing the wear of the hydraulic hose and electric cable, and their damage due to rubs against other parts.

The spreader for multistage container stacking related to the third aspect of the invention is the spreader for multistage container stacking according to the first or second aspect, further including a control unit which downwardly moves the flipper beam while detecting the amount of downward movement of the flipper beam by the rotary encoder; detects the height of the lower end of the container by the lower end detecting sensor to stop the descent of the flipper beam; and lifts the flipper beam at a creep speed in accordance with a correction amount calculated, thereby to register the lock pin with the central position of the side surface opening of the container lower corner fitting in the height direction. Thus, even if the flipper beam is lowered at a high speed to bring the position of detection by the lower end detecting sensor excessively downwards, accurate registration in the height direction can be performed using the calculated correction value.

The spreader for multistage container stacking related to the fourth aspect of the invention is the spreader for multistage container stacking according to the first or second aspect, further including a control unit which downwardly moves the flipper beam while detecting and monitoring the amount of movement of the flipper beam by the rotary encoder; detects the height of the lower end of the container by the lower end detecting sensor to stop the descent of the flipper beam, and starts the creep-speed ascent of the flipper beam; and stops the creep-speed ascent of the flipper beam in response to a signal produced when the lower end detecting sensor detects the height of the lower end of the container, thereby registering the lock pin with the central position of the side surface opening of the container lower corner fitting in the height direction. Thus, even if the flipper beam is lowered at a high speed to bring the position of detection by the lower end detecting sensor excessively downwards, accurate registration in the height direction can be performed by detection with the lower end detecting sensor.

The spreader for multistage container stacking related to the fifth aspect of the invention is the spreader for multistage container stacking according to the third or fourth aspect, in which the height of the container to be hoisted by the spreader can be detected individually based on the detection by the rotary encoder of an ascending or descending distance during the upward or downward movement of the flipper beam, and the detection of the lower end of the container by the lower end detecting sensor. Thus, the individual container height can be detected. This information on the container height can be recorded into the managing computer in the container yard. Hence, the spreader is moved at a reasonable height of container hoisting. As a result, the effect can be obtained that highly efficient container handling can be done in minimum carriage cycle time.

While the invention has been described with reference to the preferred embodiments, it is to be understood that various changes and modifications may be made without departing from the spirit and scope of the invention. All such modifications as would be obvious to one skilled in the art are intended to be included within the scope of the following claims.

We claim:

1. A spreader for multistage container stacking, comprising:

a flipper beam having a pair of corner flippers upwardly and downwardly movable along an end surface of an end beam of the spreader;

a couple of right and left wires paid out from a pair of drums on the end beam, guided vertically downwardly along the opposite ends of the end beam, and tied at the ends thereof to positions on opposites sides of the center of gravity of the flipper beam and the corner flipper to support the flipper beam;

a flipper lock pin mounting/removing device provided on a vertical side surface of each corner flipper, said flipper lock pin mounting/removing device having a lock pin insertible into and removable from a side surface opening of the spreader or a lower corner fitting of a container;

a rotary encoder provided in association with said drums for detecting the amount of upward or downward movement of the flipper beam; and a lower end detecting sensor provided on the flipper beam for detecting the lower end of the container and positioned and oriented such that light transmitted thereby is transmitted in a horizontal plane obliquely with respect to each of the lower corners of the container.

2. The spreader for multistage container stacking of claim 1, wherein a link arm is coupled to shafts between the end beam and the flipper beam so as to be foldable along the end surface of the end beam, and a hydraulic hose and an electric cable are held on said link arm for connection between the end beam and the flipper beam.

3. The spreader for multistage container stacking of claim 1, further including a control unit which downwardly moves the flipper beam while detecting the amount of downward movement of the flipper beam by the rotary encoder; detects the height of the lower end of the container by the lower end detecting sensor to stop the descent of the flipper beam; and lifts the flipper beam at a creep speed in accordance with a correction amount calculated, thereby to register the lock pin with the central position of the side surface opening of the container lower corner fitting in the height direction.

4. The spreader for multistage container stacking of claim 3, wherein the height of the container to be hoisted by the spreader can be detected individually based on the detection by the rotary encoder of an ascending or descending distance during the upward or downward movement of the flipper beam, and the detection of the lower end of the container by the lower end detecting sensor.

5. The spreader for multistage container stacking of claim 1, further including a control unit which downwardly moves the flipper beam while detecting and monitoring the amount of movement of the flipper beam by the rotary encoder; detects the height of the lower end of the container by the lower end detecting sensor to stop the descent of the flipper beam, and starts the creep-speed ascent of the flipper beam; and stops the creep-speed ascent of the flipper beam in response to a signal produced when the lower end detecting sensor detects the height of the lower end of the container, thereby registering the lock pin with the central position of the side surface opening of the container lower corner fitting in the height direction.

6. A spreader for multistage container stacking, comprising an upwardly and downwardly movable flipper beam, the improvement comprising:

a lower end detecting sensor that transmits a detecting medium provided on the flipper beam for detecting a lower end of a container, said lower end detecting sensor being positioned and oriented so that the detecting medium is transmitted in a horizontal plane obliquely with respect to a lower corner of the container.

7. The spreader for multistage container stacking of claim 6, further comprising:

a link arm provided foldably between an end beam secured to the spreader and the upwardly and downwardly movable flipper beam; and a hydraulic hose and an electric cable held on the link arm for connection between the end beam and the flipper beam.

8. A spreader for multistage container stacking, comprising an upwardly and downwardly movable flipper beam, the improvement comprising:

a rotary encoder for detecting the amount of upward or downward movement of the flipper beam;

a lower end detecting sensor provided on the flipper beam for detecting a lower end of a container; and a control unit which downwardly moves the flipper beam while detecting the amount of downward movement of the flipper beam by the rotary encoder; detects the lower end of the container by the lower end detecting sensor to stop descent of the flipper beam; calculates as a correction amount the amount of downward movement of the flipper beam detected by the rotary encoder during a period from detection by the lower end detecting sensor until stoppage of the flipper beam; and lifts the flipper beam at a creep speed in accordance with the correction amount, thereby positioned the flipper beam correctly in a height direction.

9. The spreader for multistage container stacking of claim 8, further comprising:

a link arm provided foldably between an end beam secured to the spreader and the upwardly and downwardly movable flipper beam; and a hydraulic hose and an electric cable held on the link arm for connection between the end beam and the flipper beam.

10. A spreader multistage container stacking, comprising an upwardly and downwardly movable flipper beam, the improvement comprising:

a lower end detecting sensor provided on the flipper beam for detecting a lower end of a container; and a control unit which downwardly moves the flipper beam; detects the lower end of the container by the lower end detecting sensor to stop descent of the flipper beam, and starts creep-speed ascent of the flipper beam; and stops the flipper beam in response to a signal produced when the lower end detecting sensor detects the lower end of the container again, thereby positioning the flipper beam correctly in a height direction.

11. The spreader for multistage container stacking of claim 10, further comprising:

a link arm provided foldably between an end beam secured to the spreader and the upwardly and downwardly movable flipper beam; and a hydraulic hose and an electric cable held on the link arm for connection between the end beam and the flipper beam.

12. A spreader for multistage container for stacking, comprising an upwardly and downwardly movable flipper beam, the improvement comprising:

a rotary encoder for detecting the amount of upward or downward movement of the flipper beam; and a lower end detecting sensor provided on the flipper beam for detecting a lower end of a container, whereby a height of the container to be hoisted by the spreader can be detected individually based on an ascending or descending distance of the flipper beam detected by the rotary encoder when the flipper beam is moved upward or downward and the lower end detecting sensor detects the lower end of the container.

13. The spreader for multistage container stacking of claim 12, further comprising:

a link arm provided foldably between an end beam secured to the spreader and the upwardly and downwardly movable flipper beam; and a hydraulic hose and an electric cable held on the link arm for connection between the end beam and the flipper beam.

* * * * *